United States Patent [19]

Roberts

[11] Patent Number: 4,543,043

[45] Date of Patent: Sep. 24, 1985

[54] VARIABLE DISPLACEMENT COMPRESSOR

[75] Inventor: Richard W. Roberts, Lombard, Ill.

[73] Assignee: Borg-Warner Corporation, Chicago, Ill.

[21] Appl. No.: 613,692

[22] Filed: May 24, 1984

Related U.S. Application Data

[62] Division of Ser. No. 404,078, Aug. 2, 1982, Pat. No. 4,475,871.

[51] Int. Cl.[4] ..... F04B 1/26

[52] U.S. Cl. ..... 417/222; 417/270

[58] Field of Search ..... 417/222, 270; 92/12.2; 91/475

[56] References Cited

U.S. PATENT DOCUMENTS

| | | | |
|---|---|---|---|
| 1,521,884 | 1/1925 | Higgins, Jr. | 91/475 |
| 2,016,802 | 10/1935 | Fick | 91/475 |
| 2,129,828 | 9/1938 | Donn | 417/222 |
| 2,486,690 | 11/1949 | Tipton | 91/475 |
| 3,010,403 | 11/1961 | Zubaty | 417/222 |
| 4,037,993 | 7/1977 | Roberts | 417/222 |
| 4,073,603 | 2/1978 | Abendschein | 417/222 |

*Primary Examiner*—William L. Freeh

*Attorney, Agent, or Firm*—Florian S. Gregorczyk

[57] ABSTRACT

An axial piston, variable displacement, wobble plate gas or vapor compressor having improved wobble plate control for rapid response to a compressor inoperative mode. Either a mechanical or spring means serves to maintain the reference position during inoperation of the compressor. This control of the wobble plate position provides for rapid response during either operation or inoperation of the compressor, and also provides a stabilizing means which inhibits undesired wobble plate movement at low crankcase pressures.

1 Claim, 6 Drawing Figures

VARIABLE DISPLACEMENT COMPRESSOR

This is a division of application Ser. No. 404,078 filed Aug. 2, 1982, now U.S. Pat. No. 4,475,871.

BACKGROUND OF THE INVENTION

1. Field of the Invention

Axial piston, wobble plate compressors of the type having a wobble plate and cam mechanism, adjustable to varying angles with respect to the drive axis, to control the stroke length of the pistons driven by the wobble plate and cam mechanism.

2. Description of the Prior Art

U.S. Pat. No. 4,073,603 (Abendschein et al.), assigned to the same assignee as the present invention, describes a wobble plate compressor with the wobble plate supported on a hinge ball with the torque loads transmitted in an improved manner. The present invention is an improvement over Abendschein et al. in that the hinge ball is biased to a pre-set equilibrium condition to provide an increased restoring force at increasing stroke, to reduce the tendency of such compressors to go into stroke at low ambient temperatures and to improve the stability of the control system for regulating the wobble plate angle.

U.S. Pat. No. 3,861,829 (Roberts et al.), assigned to the same assignee as the present invention, describes a wobble plate compressor using controlled, under-piston gas pressure to vary the inclination of the wobble plate, which is supported on a universal joint.

U.S. Pat. No. 3,552,886 (Olson) shows a spherical bearing or hinge ball supporting the drive/wobble plate assembly.

U.S. Pat. Nos. 2,980,025 (Wahlmark) and 2,964,234 (Loomis) both show the concept of pivoting the wobble plate assembly to a point spaced from the drive axis to maintain essentially constant clearance volume.

SUMMARY OF THE INVENTION

The present invention is useful with an axial piston, variable displacement, wobble plate compressor having a plurality of gas working spaces, and a corresponding plurality of pistons. Each piston is positioned in one of the gas working spaces and is connected by means of a ball ended rod to a variable angle wobble plate mechanism. The compressor includes a drive shaft having a central, cylindrical portion disposed along a longitudinal axis. The cylindrical portion defines an annular slot in proximity to the gas working spaces. At least one thrust flange member is provided, and it extends radially from the drive shaft cylindrical portion, and defines a shoulder where it joins the cylindrical portion. A hinge ball supports the wobble plate and cam mechanism and defines a bore to receive the drive shaft, and thus is slidable along the drive shaft to accommodate changes in the wobble plate inclination.

Particularly in accordance with the present invention, a snap ring is positioned in the annular slot of the drive shaft. A piston-stroke-increasing bias spring is positioned around the drive shaft between the snap ring and the hinge ball. In addition a piston-stroke-decreasing spring is mounted on the drive shaft between the hinge ball and the shoulder at the junction of the thrust flange member and the drive shaft cylindrical portion. The opposing forces of the stroke increasing spring and the stroke decreasing spring position the hinge ball in a minimum stroke condition of the wobble plate structure and thus fix minimum piston stroke. The inventive structure provides accurate control and regulation of the wobble plate angle at its minimum stroke position, and provides improved control of the compressor.

Other advantages will be apparent from the description of the preferred embodiment whch follows.

DESCRIPTION OF THE DRAWINGS

In the figures of the drawings, like reference numerals identify like components and in the drawings.

DESCRIPTION OF THE PREFERRED EMBODIMENT

Figure 1:
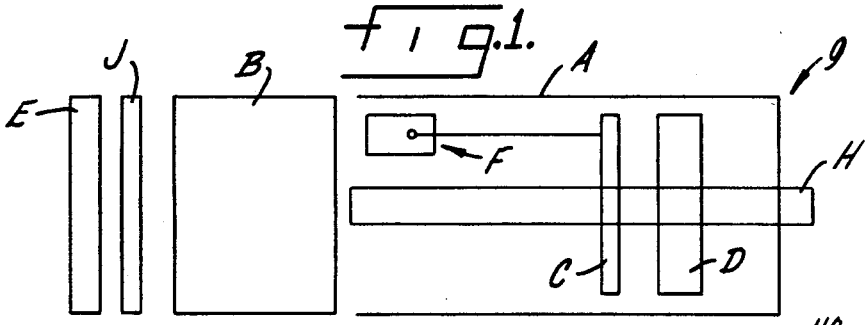
FIG. 1 is a diagrammatic and exploded side view of the present invention.
Figure 3:
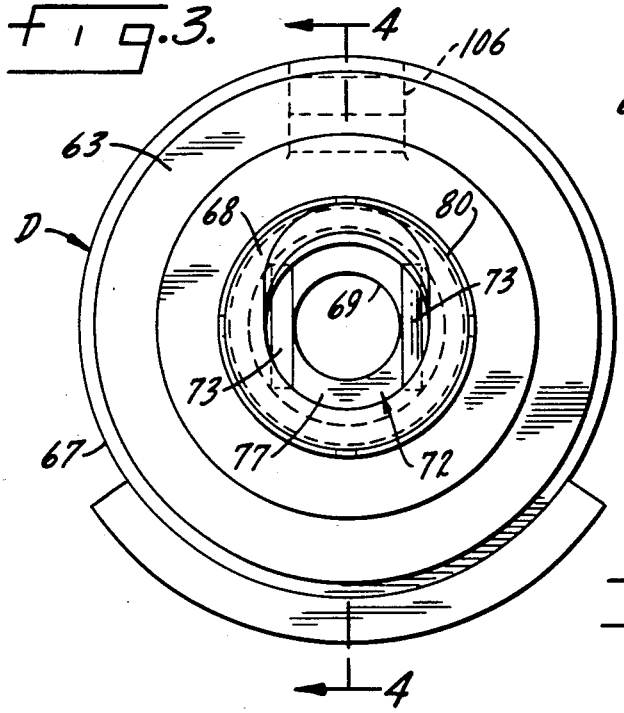
FIG. 3 is a plan view of the drive plate assembly.

For purposes of this description, the compressor 9 as shown diagrammatically in FIG. 1 may be regarded as being organized in a plurality of subassemblies. The mechanical parts are disposed within a housing A which is generally cylindrical in crosssection, provided with continuous side walls and opposed open ends into which the working parts are received. The other major subassemblies include a cylinder block B, a wobble plate C, a drive plate assembly D, a head assembly E, the pistons and associated connecting rods F, capacity control unit G (see FIG. 2), drive shaft assembly H and valve plate J.

Figure 2:
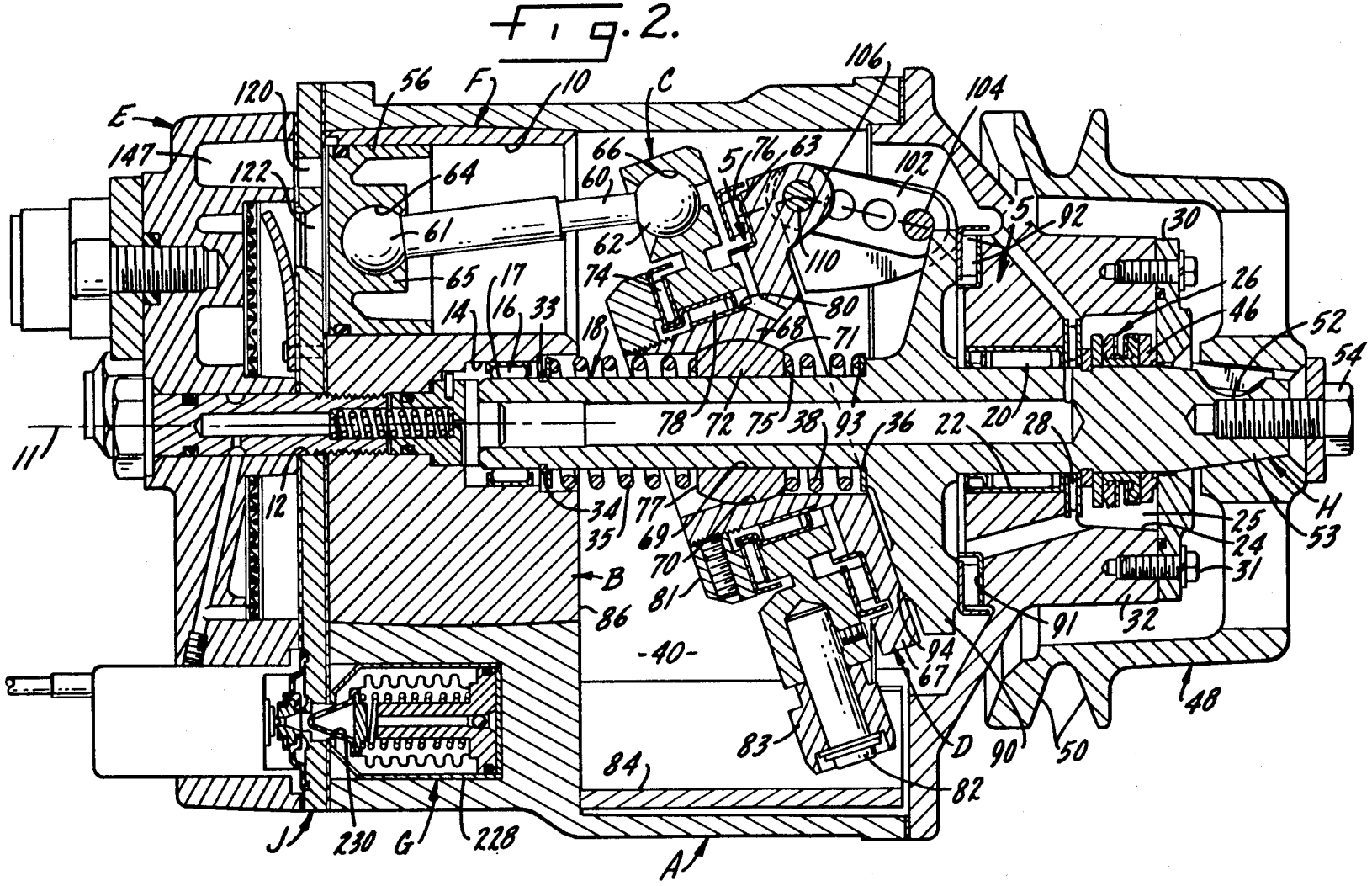
FIG. 2 is an elevation view, partly in cross-section, of a preferred embodiment of the present invention.

As shown in FIG. 2, which is a cross section view, cylinder block B is provided with a plurality of spaced cylinders or gas working spaces 10. The axes of the cylinders are parallel to the drive shaft axis 11, but is is understood that it is possible to arrange such cylinders along nonparallel axes without departing from the principles of the invention. Also, while only one cylinder is shown in FIG. 2, the actual number is a matter of choice in design, although there is obviously some practical upper limit. The operation of the design shown requires at least three cylinders since the control of the wobble plate position depends on the balancing forces resulting from the geometry of the wobble plate pivot point with respect to the drive axis.

The cylinder block B includes a centrally located axial bore 12 (as shown at the left hand side of FIG. 2) forming a part of the lubricant distribution system. There is also a counterbore 14 which receives a rear radial bearing 16, shown as the needle or roller bearing type. Radial bearing 16 supports the rear end 17 of a drive shaft 18. The terms "front", "rear", etc. are of course arbitrary; but in this description the front of the compressor is in the right-hand portion of FIG. 2, and the rear of the compressor is in the left-hand portion of FIG. 2.

Drive shaft 18 with a central cylindrical portion 19 is supported at its front end by a front radial bearing assembly 20. Housing A is provided with a central axial bore 22 which receives front radial bearing 20, and a counterbore 24 forming a cavity 25 adapted to accommodate a seal assembly 26 and a small thrust bearing 28. The right hand end (as viewed in FIG. 1) of the housing is closed by a seal plate 30 which is secured by a plurality of machine screws 31 threaded into the annular section 32 surrounding cavity 25 at the right hand end of the housing.

The interior of housing A is broadly described as a crankcase 40 which is completely sealed except for the clearances between the pistons and the cylinder walls and the passages for oil flow through the drive shaft to the bearings. Seal assembly 26 at the right-hand end of the drive shaft is fluid tight and designed to increase sealing as the pressure rises within the crankcase. Sealing contact is made between rotating seal element 46 and the inside surface of seal plate 30.

The drive shaft is driven by means of a pulley 48 and provided with V-belt engaging flanges 50. Pulley 48 is keyed at key way 52 to a tapered section 53 of drive shaft 18 and held in place by a machine screw 54 at the end thereof. Although the compressor is described as being driven by a pulley, because one principal application for the compressor is in an automotive air conditioning system driven by the accessory drive belt, it should be understood that any suitable drive means may be provided.

The piston and connecting rod assembly F includes pistons 56 connected to wobble plate C by means of connecting rods 60, each having ball shaped enlarged sections 61, 62 at opposite ends thereof which may be captured in sockets formed respectively in the pistons and wobble plate. As viewed in FIG. 2, the left-hand end section 61 of each connecting rod is secured to the underside of the pistons and received within a complementary shaped socket 64 formed in a thickened portion 65 of piston 56 at the center thereof. The opposite ball shaped end 62 of the connecting rod is received within a complementary socket 66 formed in wobble plate C. This arrangement allows a number of degrees of freedom, in all directions, between the respective ends of the connecting rods both at the piston and at the wobble plate.

Figure 4:
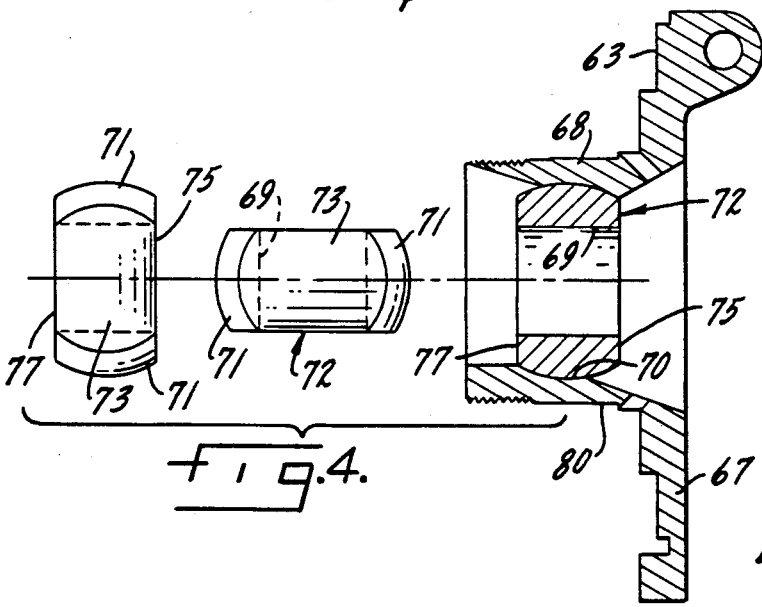
FIG. 4 is a cross-section view of the drive plate assembly taken on line 4—4 of FIG. 3.
Figure 5:
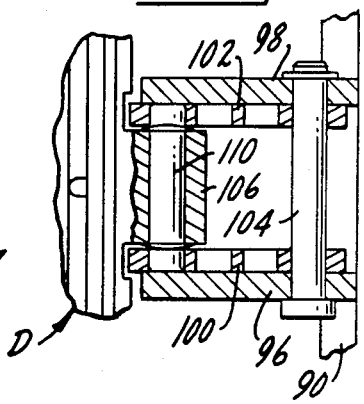
FIG. 5 is an elevation view of the pin and link arrangement, taken along line 5—5 of FIG. 1.

The wobble plate C is rotatably supported on the drive plate assembly D (see FIGS. 3–6) which includes an annular flange 67 extending radially from the drive shaft axis, drive plate surface 63 and an axial hub section 68. This hub section is hollow and formed with an internal spherical surface 70 to receive the main wobble plate and drive plate bearing member, hinge ball 72. Hinge ball 72 is formed with a bore 69 for drive shaft 18, opposed spherical surfaces 71 and opposed cylindrical surfaces 73 to allow insertion into hub section 68 as shown in FIG. 4. Hinge ball 72 defines a front face 75 and a rear face 77.

Wobble plate C is mounted for relative rotary movement with respect to rotating drive plate assembly D by means of three sets of bearings: rear wobble plate thrust bearing 74; front wobble plate thrust bearing 76; and radial wobble plate bearing 78. The inner race of radial bearing 78 is mounted on the outer diameter (OD) 80 of axial hub section 68 of the drive plate assembly so that the drive plate, which acts as a cam mechanism, can rotate freely with respect to the wobble plate. A balance weight ring 81 is secured to the nose of hub section 68. Wobble plate C is restrained against rotative movement by means of anchoring pin element 82 and cooperating block 83. When the compressor is in the stroke, the anchoring block slides back and forth within a U-shaped track 84 attached to the front face of cylinder block B.

The drive shaft assembly, including a thrust flange 90 which is formed on and rotates with the drive shaft 18, is spaced from surface 91 on the inside of the housing by means of a large thrust bearing assembly 92. The junction of thrust flange 90 and drive shaft 18 defines a shoulder 93 extending a short distance outwardly perpendicular from the axis of drive shaft 18. A bearing-retaining section 94 is provided on the thrust flange at the same angle as the maximum inclination of the wobble plate at maximum stroke operation of the compressor. At the top of flange 90 are a pair of spaced apart, rearwardly extending flanges 96, 98 (see FIG. 5) which are adapted to support links 100, 102 connecting drive plate assembly D to drive shaft assembly H.

This driving connection arrangement virtually eliminates the application of torque through the links 100 and 102 which, because of their relatively small size, are not suitable as drive transmission elements. Flanges 96, 98 are joined to the front end of links 100, 102 by means of a pin 104, while the opposite end of each link is pivotally secured by means of a pin 110 to a lug 106 projecting from the front of drive plate D. Torque is transmitted from flanges 96, 98 to lug 106 on the drive plate without producing a bending moment on the links 100, 102.

Drive shaft 18 is of a generally cylindrical shape and defines an annular slot 33 ahead of rear radial bearing 16 to receive a snap-ring or annular washer 34 to serve as an abutment. Positioned about drive shaft 18 between snap-ring 34 and hinge ball rear surface 77 is a piston-stroke-increasing bias spring 35 providing a force tending to move the wobble plate-drive plate assemblage mounted on hinge ball 72 toward a maximum piston stroke direction along shaft 18. A shim or series of shims 36 are mounted on drive shaft 18 and abut shoulder 93. Positioned about drive shaft 18 between hinge ball front face 75 and shoulder 93 is a piston-stroke-decreasing bias spring 38 providing a force tending to move the wobble plate-drive plate assembly mounted on hinge ball 72 toward a minimum piston stroke position. By varying the number and location of shims 36 a simple, inexpensive and controllable restoring spring force adjustment means is provided. The bias forces of springs 35 and 38 tend to move hinge ball 72 along drive shaft 18 in opposite directions, however, at an equilibrium balanced position hinge ball 72 is positioned to provide a nominal stroke of about 0.100 inch to pistons 56. This contra acting balance of spring forces provides a rapidly increasing restoring force at increased piston stroke, to thus reduce the tendency of such a compressor to go into stroke at low ambient temperatures and further improve the stability of the control system regulating the wobble plate angle.

The capacity control system G of FIG. 2 includes a valve member 228 which controls the pressure maintained within crankcase 40 in response to the suction pressure and, therefore, controls the angle of inclination of the wobble plate and drive plate assemblies. The refrigerant vapor will flow by the piston rings to increase the pressure within the crankcase. The bellows control valve 228 expands in response to low suction pressure, restricting the annular orifice area 230 defined by valve G, thereby restricting the flow from the crankcase 40 to suction plenum 147 defined by head E, causing crankcase pressure to increase. Increased crankcase pressure acting on the underside of the pistons, by virtue of the articulated pivot point being spaced from the drive shaft axis, causes the drive plate and wobble plate to move toward the vertical position, decreasing stroke and capacity. Conversely, reduction in crankcase pressure will cause the wobble plate and drive plate assemblies to move toward a more inclined position, increasing stroke and capacity. Fluid is communicated to cylinders 10 through suction ports 120 and discharged through discharge ports 122 which ports are defined by valve plate J.

This compressor is continuously rotating during drive means operation. In a compressor inoperative mode, the wobble plate is at a minimum stroke condition. The wobble plate is never allowed to move completely to a zero stroke position; otherwise there would be no vapor admitted to the gas working spaces and therefore nothing for the pistons to react against in order to force the wobble plate to an inclined or operative position.

OPERATION

It will be assumed that, initially, the compressor is in its full stroke operation, substantially as depicted in FIG. 2.

As pulley 48 is driven, torque is transmitted to drive shaft 18. The thrust flange connected to the drive shaft will rotate and the flanges 96, 98 transmit the torque through the links 100, 102 to the drive plate surface 63 without producing a bending moment on the links. As the drive plate surface 63 rotates, it acts as a cam mechanism driving the wobble plate in a nutating path. The restraint block 82 slides back and forth in track 84 as the pistons reciprocate in cylinders 10.

As described in the aforementioned Roberts et al. U.S. Pat. No. 3,861,829, the crankcase pressure, created by gas blowing by the pistons, is modulated to control the angle of the drive plate and therefore the length of stroke. The geometry of the pivot points of links 100, 102 with respect to the drive axis is such that an increase in crankcase pressure will act against the underside of the pistons, and the resultant force will cause the wobble plate to move to a more vertical position, decreasing stroke length and capacity. Conversely, a decrease in crankcase pressure will allow the force of the gas in the working spaces to move the wobble plate to a more inclined position, increasing stroke length and capacity.

In Abendschein et al. U.S. Pat. No. 4,073,603, the crankcase pressure and thus the capacity of the compressor was precisely controlled in response to suction pressure. This control was attained through a solenoid and bellows valve and by the maintenance of a pressure gradient acting on the pistons to maintain a minimum piston stroke.

Particularly in accordance with the invention, springs 35, 38 provide a restoring force acting on hinge ball 72 and thus wobble plate C and drive plate assembly D. This spring restoring force acts as an adjunct to the crankcase gas pressure and reduces the range over which the crankcase pressure must operate to restore the wobble plate to the equilibirum position. Crankcase pressure is controlled through the bellows control valve 228. This spring force allows a minimal piston stroke and a more rapid response to actuation of the control valve. Further, the spring force acting on hinge ball 72 eliminates the tendency of such compressors to inadvertantly go into stroke at very low ambient temperatures.

Figure 6:
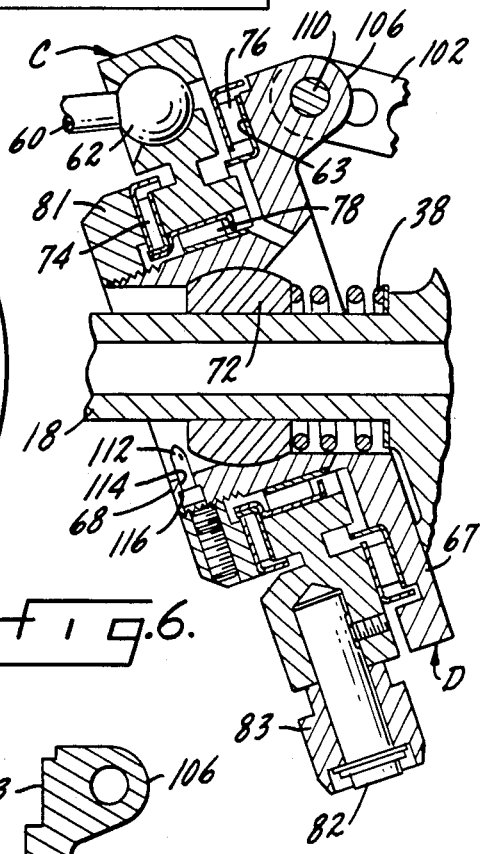
FIG. 6 is an elevation view, partly in cross-section, of an alternative embodiment of the present invention.

In an alternating embodiment illustrated in FIG. 6 stroke-decreasing spring 38 cooperates with a positive stop pin 112 mounted in axial hub section 68. As shown in FIG. 4, axial hub section 68 defines a pin bore 114 and a pin counterbore 116 to receive positive stop 112. Stop 112 may be secured in pin bore 114 by means known in the art, such as welding or staking.

In the alternative embodiment of FIG. 6, stop pin 112 renders unnecessary stroke-increasing spring 35, snap ring 34 and annular slot 33 of FIG. 2. Stop pin 112 serves to maintain the wobble plate and cam mechanism at the minimum piston stroke position noted above when positive stop 112 contacts drive shaft 18 at its outer diameter.

While this invention has been described in connection with a specific embodiment thereof, it is to be understood that this is by way of illustration only and not by way of limitation and the scope of the appended claims should be construed as broadly as the prior art will permit.

I claim:

1. An axial piston, variable displacement, wobble plate compressor with a plurality of gas working spaces and corresponding plurality of pistons, each positioned in one of said spaces, a drive shaft having a central, cylindrical portion disposed along a longitudinal axis, at least one thrust flange member extending radially from said cylindrical portion and defining a shoulder at the junction with said cylindrical portion, a hinge ball defining a bore to receive the drive shaft and be slidable thereon, a wobble plate and hub assembly with said hinge ball mounted in said hub which hub defines a pin bore and counterbore, means operably connected between said wobble plate and pistons to impart reciprocating drive to said pistons, said compressor stroke being responsive to pressure differentials across said pistons between an inoperative mode and a range of operative modes, wherein the improvement comprises a positive stop pin mounted in said pin bore and counterbore and a piston-stroke-decreasing spring mounted on said drive shaft between said hinge ball and said shoulder at the junction of said thrust flange member and the cylindrical portion of said drive shaft, said stop pin maintaining said wobble plate and hinge ball assembly at about 0.100 inch piston stroke in an inoperative mode of said compressor, said piston-stroke-decreasing spring acting as the sole bias means on said hinge ball during the inoperative mode with the exception of said pressure differential across said pistons.

* * * * *